United States Patent [19]

Roane

[11] 4,258,479

[45] Mar. 31, 1981

[54] TETRAHEDRON BLOCKS CAPABLE OF ASSEMBLY INTO CUBES AND PYRAMIDS

[76] Inventor: Patricia A. Roane, 1100 Fulton St. #7, San Francisco, Calif. 94117

[21] Appl. No.: 11,114

[22] Filed: Feb. 12, 1979

[51] Int. Cl.[3] ..... A63H 33/04

[52] U.S. Cl. ..... 434/211; 46/24; 434/403

[58] Field of Search ..... 35/34, 72; 46/24, 25

[56] References Cited

U.S. PATENT DOCUMENTS

| | | | |
|---|---|---|---|
| 595,782 | 12/1897 | Morsell | 35/72 |
| 1,471,943 | 10/1923 | Chambers . | |
| 2,041,030 | 5/1936 | Strutton . | |
| 2,839,841 | 6/1958 | Berry . | |
| 2,939,243 | 6/1960 | Duggar | 46/24 |
| 3,645,535 | 2/1972 | Randolph . | |
| 3,655,201 | 4/1972 | Nichols | 46/25 X |
| 3,659,360 | 5/1972 | Zeischegg . | |
| 3,662,486 | 5/1972 | Freedman . | |
| 3,746,345 | 7/1973 | Palazzolo . | |
| 3,782,029 | 1/1974 | Bardot . | |
| 3,974,611 | 8/1976 | Satterthwaite . | |
| 4,026,087 | 5/1977 | White . | |
| 4,051,621 | 10/1977 | Hogan . | |
| 4,063,725 | 12/1977 | Snyder . | |

FOREIGN PATENT DOCUMENTS

| | | | |
|---|---|---|---|
| 601533 | 8/1934 | Fed. Rep. of Germany | 46/24 |
| 429509 | 5/1935 | France | 46/24 |
| 830116 | 5/1938 | France | 46/24 |

OTHER PUBLICATIONS

Pipet Color Codes, Fisher Scientific Cϕ., p. 804, 1965 catalog.

*Primary Examiner*—Harland S. Skogquist
*Attorney, Agent, or Firm*—Owen, Wickersham & Erickson

[57] ABSTRACT

A series of interrelated sets of tetrahedron blocks. Each set is capable of assembly into a cube with all the cubes being identical in size. Typically, there are at least three such sets, though there may be more; and when there are three sets, for example, one set contains twice as many tetrahedron blocks as the second set and four times as many as the third set. The tetrahedrons are preferably hollow and each of them has a magnet for each face, e.g., affixed to the interior walls of its faces, the magnets being so polarized that upon assembly into a cube or pyramid, the magnets of facing faces attract each other. Preferably, the blocks are colored in such a way that faces of the same size and shape are colored alike and each size and shape has a different color.

21 Claims, 18 Drawing Figures

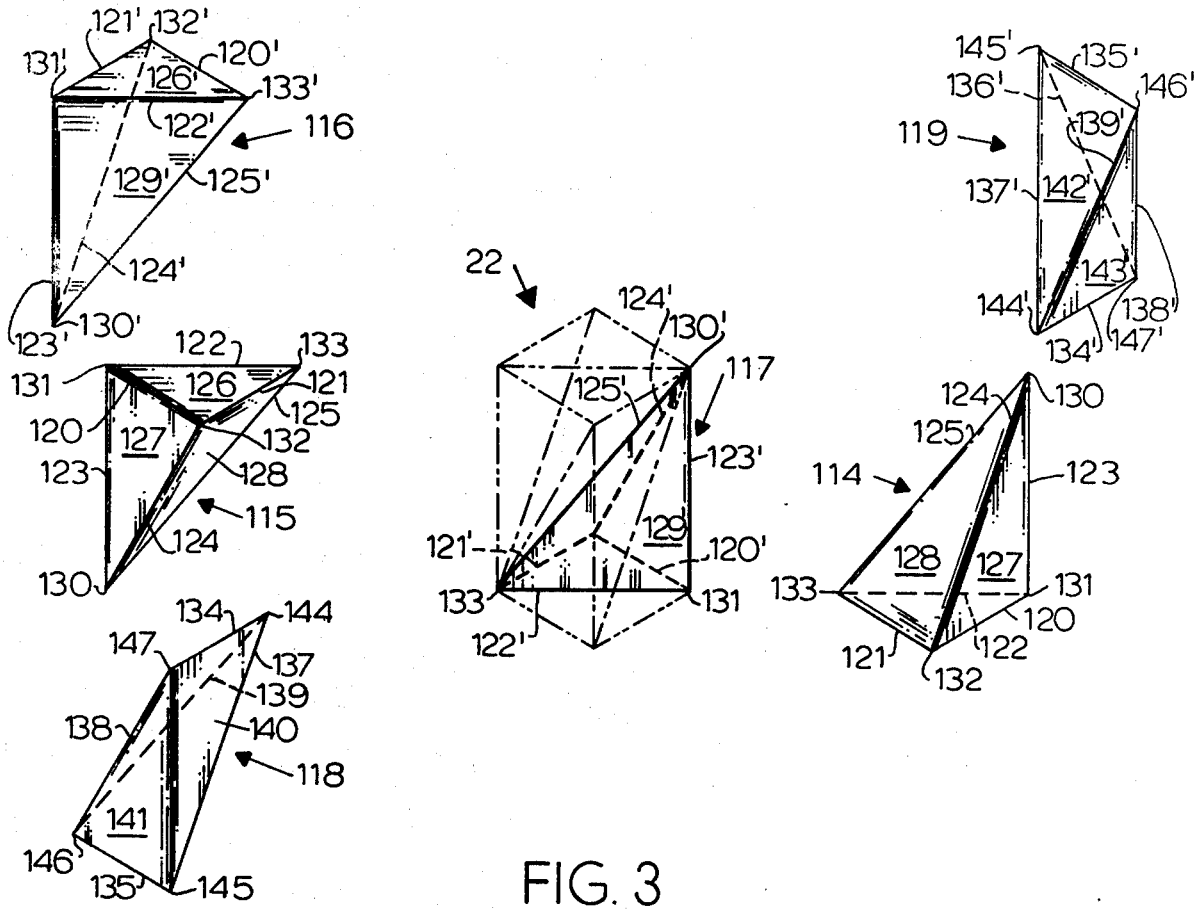
FIG. 3
FIG. 4
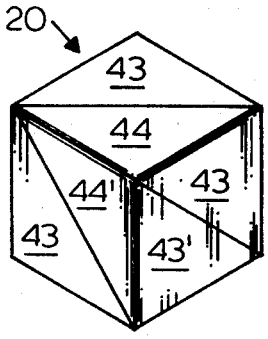
FIG. 4-A
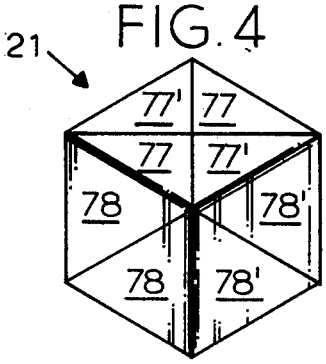
FIG. 4-B
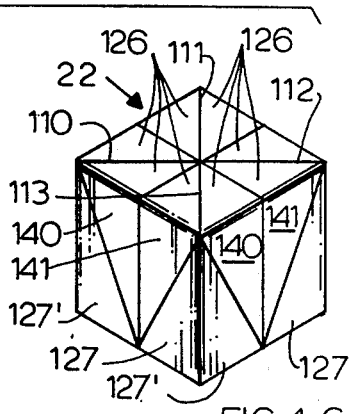
FIG. 4-C
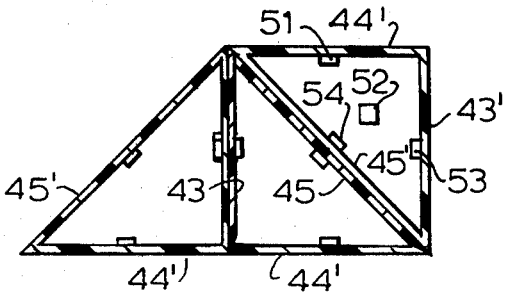
FIG. 5

FIG. 9
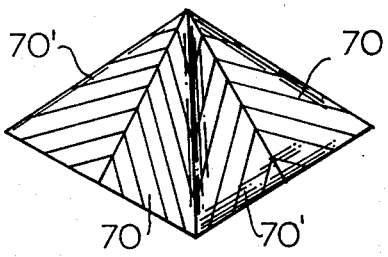
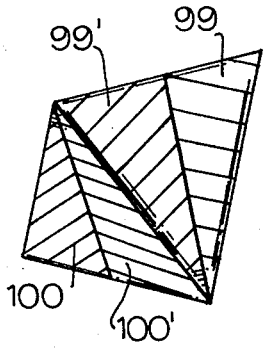
FIG. 10
FIG. 11
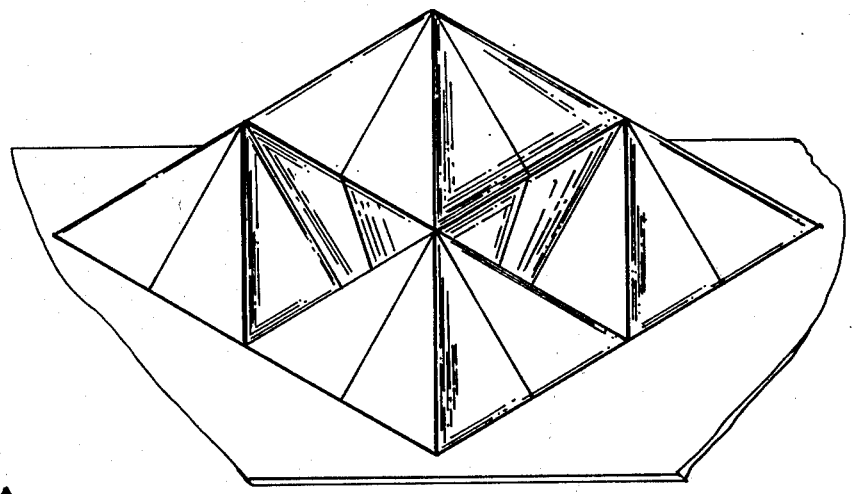
FIG. 12
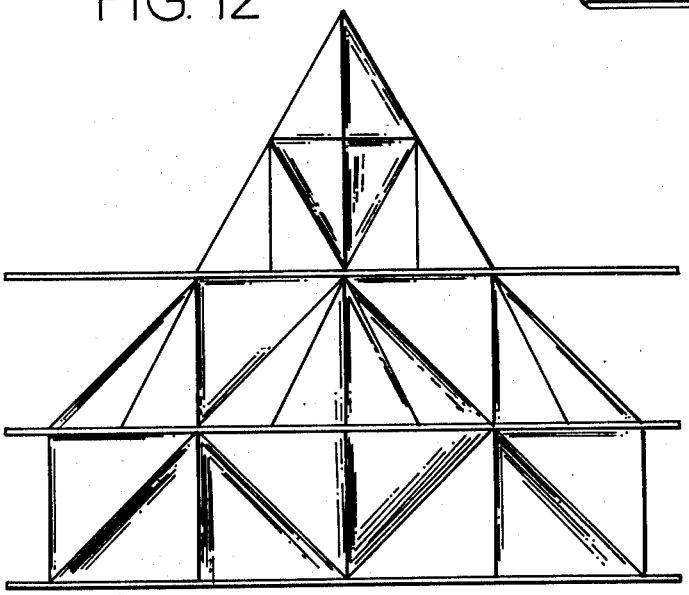
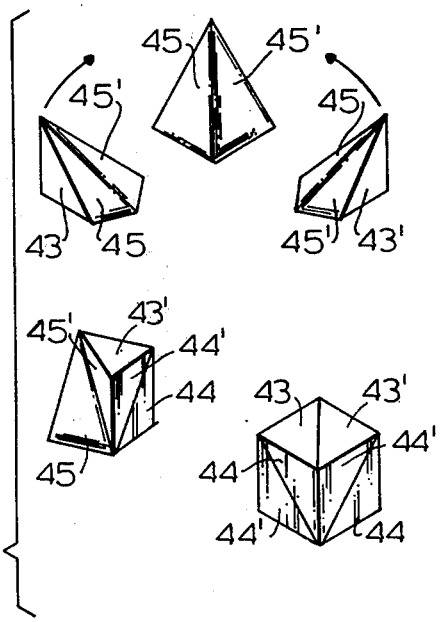
FIG. 13

TETRAHEDRON BLOCKS CAPABLE OF ASSEMBLY INTO CUBES AND PYRAMIDS

BACKGROUND OF THE INVENTION

This invention relates to a group or groups of blocks, each of which is shaped as a tetrahedron.

In one arrangement, the group comprises interrelated sets having different numbers of blocks, each set being capable of assembly into a cube, and all of the cubes being the same size.

In another arrangement, each set has twelve blocks and is capable of assembly into a rectangular parallelepiped; each set is also capable of assembly as an eight-block pyramid and a four-block tetrahedron. Many other solids may be formed from either such group.

The tetrahedron, the simplest polygonal solid, is of special interest, in that all other polygonal solid figures can be broken down into tetrahedrons. In this manner, a number of shapes can be produced by assembling various tetrahedrons. The group of blocks may be viewed either as an educational device for study of solids, as a playset for amusement of children or grown-ups, or as a puzzle for grownups or children.

In its educational aspect, a great deal can be learned about various solid figures, including not only pyramids and cubes but a great variety of figures, by superposition and interrelation of the tetrahedrons included in the sets of this invention. The blocks may be related to architecture and history, and also may lead to geometrical speculation.

When used either for play or as a puzzle, the invention provides numerous opportunities for assembling various shapes from the tetrahedrons. Storage is normally done by assembling them together in cubes or parallelepipeds or segments thereof; and when the blocks are all spread out it takes ingenuity and understanding to reassemble them into the cube, particularly a cube related to the particular set. As stated, pyramids or pyramidal groups may be constructed; so may octahedrons, and so on.

Thus, among the objects of the invention are those of enabling study and amusement, of facilitating observation, of improving manual dexterity, of illustrating relations between various solid figures, and so on, by the use of tangible blocks. These blocks are preferably made so that they can be held to each other magnetically; and they are also preferably colored, when the color relationship is helpful. To make the group more puzzling, of course, the color relationship may be avoided.

SUMMARY OF THE INVENTION

The invention comprises a group of tetrahedron blocks which may be grouped as a series of interrelated sets.

The invention demonstrates a harmony in which several each of seven tetrahedron blocks and their mirror counterparts, all having right-angle faces, come together in an orderly progression to form one system in a variety of configurations. Taken separately, multiple individual pairs can either combine as one-of-a-kind to form a variety of symmetrical polyhedrons, or combine with other one-of-a-kind pairs to form a variety of other symmetrical polyhedrons.

The tetrahedrons are preferably hollow, with magnets affixed to the interior walls of their faces, and the magnets are so arranged with respect to their polarization that upon proper assembly into a cube or pyramid the magnets of facing faces attract each other and help hold the blocks together. Without this, it is sometimes difficult to obtain or retain configurations that may be desired.

Color relationships may also be provided in order to help in assembly. Then color relationships can also be used to make other educational points.

In one arrangement, each set is capable of assembly as a cube, and all the cubes from all of the sets are the same size.

Preferably, if there are three such sets, for example, the first set contains twice as many tetrahedrons as the second set and four times as many as the third set. The tetrahedrons in the third set are thus smaller than those in the first set. There may be more than three sets, with additional sets containing twice as many tetrahedrons as in the one where they were previously most numerous.

The relationships as to the size of each of the individual sets can become interesting in itself. For example, in one embodiment of the invention, there may be a group of 42 tetrahedrons comprising three interrelated sets, each set, as stated, being arranged so that a cube can be formed with all three cubes the same size. The smallest tetrahedrons are in the first set, which may comprise 24 tetrahedrons in four subsets; the first and second subsets each comprise eight identical tetrahedrons, and those of the first subset are symmetrical to those in the second subset. The six edges of each tetrahedron of the first and second subsets are so related to the shortest edge, taking its length as 1, that the six edges have respective lengths of 1, 1, $\sqrt{2}$, 2, $\sqrt{5}$, and $\sqrt{6}$. The third and fourth subsets of this first set comprise four identical tetrahedrons each, and these two sets are also symmetrical to each other, with their six edges (again related to the shortest edge of the first two subsets taken as (1) in the relationship: 1, 1, 2, $\sqrt{5}$, $\sqrt{5}$, and $\sqrt{6}$.

The second set may comprise twelve tetrahedrons, also in four subsets, subsets five, six, seven, and eight. In this second set, the first two subsets each comprise four identical tetrahedrons; and those in the fifth subset are symmetrical to those in the sixth. The edges are related to each other and to those in the first set, so with the length of the shortest edge of the first set being taken as 1, the length of the edges of the tetrahedrons in the fifth and sixth subsets are: 29 2, $\sqrt{2}$, 2, 2, $\sqrt{6}$, and $2\sqrt{2}$. The seventh and eighth subsets contain two identical tetrahedrons each and are again symmetrical to each other; the edge relationship, on the same basis, is $\sqrt{2}$, $\sqrt{2}$, 2, $\sqrt{6}$, $\sqrt{6}$, $2\sqrt{2}$.

The third set of this group, which is given as an example of the invention, comprises six tetrahedrons and only two subsets, the ninth and tenth, one containing either three or four identical tetrahedrons, and the other either three or two, with the tetrahedrons in the tenth symmetric to those in the ninth, and the edge length relationship, taken as before is 2, 2, 2, $2\sqrt{2}$, $2\sqrt{3}$, and $2\sqrt{3}$.

In another group embodying the invention, there may be four sets of tetrahedrons having three like those already described, plus a fourth set of still smaller tetrahedrons. This fourth set may contain forty-eight tetrahedrons in four subsets, the eleventh, twelfth, thirteenth, and fourteenth. The tetrahedrons in the eleventh and twelfth subsets are symmetric to each other and, on the basis above, the edges are related as $\sqrt{2}/2$, $\sqrt{2}/2$, 1, 2, $3\sqrt{2}/2$, $\sqrt{5}$, (taken with its own shorted edge as 1, the relationship is 1, 1, $\sqrt{2}$, $2\sqrt{2}$, 3, $\sqrt{10}$). The tetrahedrons of the thirteenth and fourteenth subsets are symmetric to each other and, with the basis above, the edge-length relationship is $\sqrt{2}/2$, $\sqrt{2}/2$, 2, $3\sqrt{2}/2$, $3\sqrt{2}/2$, and $\sqrt{5}$ (taken with its own shortest edge as 1, the relationship is 1, 1, $2\sqrt{2}$, 3, 3, $\sqrt{10}$). In its relation to the first set stated above, the length of the shortest edge here would be equal to the $\sqrt{2}/2$ times the shortest edge of the first set.

Similar relationships can, of course, also be used.

In another arrangement, the invention is a combination of tetrahedrons with right-triangle faces which can be combined to form a cube and other solid figures. All tetrahedrons may be derived from a given basic square and seven primary triangles related thereto. The basic square may be folded corner to corner to form a smaller square, and so on, for the necessary times to define a total of four squares, for example, each diminishing in size from its predecessor. Of the seven primary triangles, one is an equilateral triangle and the other six are isosceles triangles. Each of the seven primary triangles incorporates a diagonal or one side of one of the squares, and each may be assigned a distinguishing color.

The squares and the interrelated seven triangular faces may be used to form seven symmetrical primary solids, namely, four distinct pyramids, all of equal height resting on four progressively enlarging squares, and three distinct equilateral tetrahedrons. All seven of these symmetrical solids are then halved and quartered so as to divide them into four equal parts. Then each of the pyramids is again divided so as to produce a total of eight equal parts. All eight parts, in all cases, are tetrahedrons with each face a right triangle.

Taken separately, from the largest to the smallest pyramid, each of which turns inside out to form a parallelepiped, the largest may be equal to two cubes (and it can in fact be reassembled into two equal cubes); the next, the medium, is equal to one cube, identical to the first two mentioned; the next, the smaller one, is equal to half the established cube; and the last, the smallest one, is equal to a fourth of a cube.

Furthermore, the rearrangement of a pyramid into a cube or a parallelepiped reveals that the pyramid is equal to $\frac{2}{3}$rds of its cube (or parallelepiped) while its matching tetrahedron is equal to $\frac{1}{3}$rd. This is revealed in the rearrangement of the largest of the pyramids (in which case only is its matching tetrahedron composed of pieces identical in shape to itself) into one of two cubes.

The invention, in this second arrangement, includes a group of tetrahedron blocks, consisting of four sets of twelve tetrahedron blocks each, each face of each block being a right triangle. Each set is capable of assembly as (a) a rectangular parallelepiped with upper and lower square faces and, alternatively, (b) a combination of a square-base pyramid with four identical isosceles triangular faces and a large tetrahedron with four identical isosceles triangle faces.

Of the four sets, a first set has as its parallelepiped a cube of height h, and its pyramid, also of height h, has its triangular faces equilateral; its large tetrahedron is also equilateral. The second, third, and fourth sets have their parallelepipeds of the same height h, and their length and breadth are, in each case, equal to each other and equal, respectively, to $h\sqrt{2}$, $h/\sqrt{2}$ and h/2; also, all their pyramids have the same height h, with the base length of every side of each being equal to h for the first said set and equal to $h\sqrt{2}$, $h/\sqrt{2}$, and h/2 for the other three sets, respectively. Finally, the faces of the large tetrahedrons are all mirror images of the faces of the pyramid of its set.

The second set consists of two matching subsets of six identical tetrahedron blocks each, those of one subset being symmetric to those of the other subset, while the first, third, and fourth sets comprising four subsets each, with two matching subsets a and b having four identical blocks each and symmetrical to those of its matching subset and two other matching subsets c and d, having two identical blocks each, and symmetrical to those of its matching subset. Being more specific, the tetrahedron blocks have the following edge lengths, where 1=shortest edge and $h=2\sqrt{2}$:

| SET | SUBSET | EDGE LENGTH |
|---|---|---|
| 4 | a,b | 1, 1, $\sqrt{2}$, $2\sqrt{2}$, 3, $\sqrt{10}$ |
| | c,d | 1, 1, $2\sqrt{2}$, 3, 3, $\sqrt{10}$ |
| 3 | a,b | $\sqrt{2}$, $\sqrt{2}$, 2, $2\sqrt{2}$, $\sqrt{10}$, $2\sqrt{3}$ |
| | c,d | $\sqrt{2}$, $\sqrt{2}$, $2\sqrt{2}$, $\sqrt{10}$, $\sqrt{10}$, $2\sqrt{3}$ |
| 1 | a,b | 2, 2, $2\sqrt{2}$, $2\sqrt{2}$, $2\sqrt{3}$, 4 |
| | c,d | 2, 2, $2\sqrt{2}$, $2\sqrt{3}$, $2\sqrt{3}$, 4 |
| 2 | | $2\sqrt{2}$, $2\sqrt{2}$, $2\sqrt{2}$, 4, 4, $2\sqrt{6}$ |

Other objects and advantages of the invention and other related structures will appear from the following description of some preferred embodiments.

BRIEF DESCRIPTION OF THE DRAWINGS

In the drawings:

FIG. 3 is a similar view of a parallelepiped comprising $\frac{1}{4}$th of a cube of the same size as before, that cube being made up of four rectangular parallelepipeds, each appearing as shown in this drawing and each made up of six tetrahedrons, so that the total cube is made of twenty-four tetrahedrons.

FIG. 4 is a view of three assembled cubes, the cube of FIG. 1 being shown at the left as FIG. 4-A, the cube of FIG. 2 in the center as FIG. 4-B, and the cube corresponding to FIG. 3 as FIG. 4-C at the right.

FIG. 5 is a somewhat fragmentary view in section of three tetrahedrons, in which each tetrahedron is hollow and has a magnet on its inner face with polarization arranged to hold properly assembled facing of the tetrahedrons together and to repel an erroneous construction.

FIG. 9 is a view in perspective of a pyramid constructed from the eight outer tetrahedrons of FIGS. 2 and 4-B, turned, with the sloping outer faces of the pyramid shaded as in FIG. 7 to indicate the color green.

FIG. 10 is a view in perspective of the inner four tetrahedrons of the cube of FIG. 4-C assembled to make a large tetrahedron. This large tetrahedron is entirely encircled and enclosed when the tetrahedrons used to make the pyramid of FIG. 9 are used to make the outer faces of the cube of FIG. 4-C. The faces have been shaded to indicate the color green.

FIG. 11 is a view in perspective of a group of four pyramids constructed from blocks of this invention.

FIG. 12 is a view in elevation of three groups of pyramids superimposed on each other and interleaved, all made from the tetrahedron blocks of this invention plus interleaving plastic sheets.

FIG. 13 is a view showing assembly of a cube generally like, but modified from, the cube of FIGS. 1 and 4-A. At the top are shown six tetrahedrons put together to give three identical subassemblies, each such assembly having two symmetric tetrahedrons; below that is shown a partial assembly made by putting two of the subassemblies together, by rotating them through an angle, illustrated by arrows at the top, and pushing them into engagement. Finally, at the bottom the cube is completed by adding the third subassembly.

FIG. 14 is a group of parallelepipeds according to a second arrangement of the invention, each one being the same height as the other and each having a square base related to the height h as follows: $h\sqrt{2}$, h, $h/\sqrt{2}$, and h/2. Each one is made from twelve tetrahedrons in either (a) two subsets of six each, those of one subset being symmetrical to those of the other, or (b) four subsets of four, four, two and two, in pairs of symmetric subsets.

FIG. 15 is a group of two pyramids each made from eight of the two largest groups of tetrahedron blocks used in FIG. 14, both from two symmetric subsets of four each.

FIG. 16 is a similar view of two additional pyramids made from the blocks of the two smaller parallelepipeds of FIG. 14. Again, each pyramid is the same height and is made from two symmetric subsets of four blocks each.

FIG. 17 is a view in elevation of a group of four large tetrahedrons, each made from four tetrahedrons used in FIG. 14 and in two symmetric subsets of two blocks each.

FIG. 18 is another view in elevation from a different viewpoint of the large tetrahedrons of FIG. 17.

DESCRIPTION OF A PREFERRED EMBODIMENT

Figure 1:
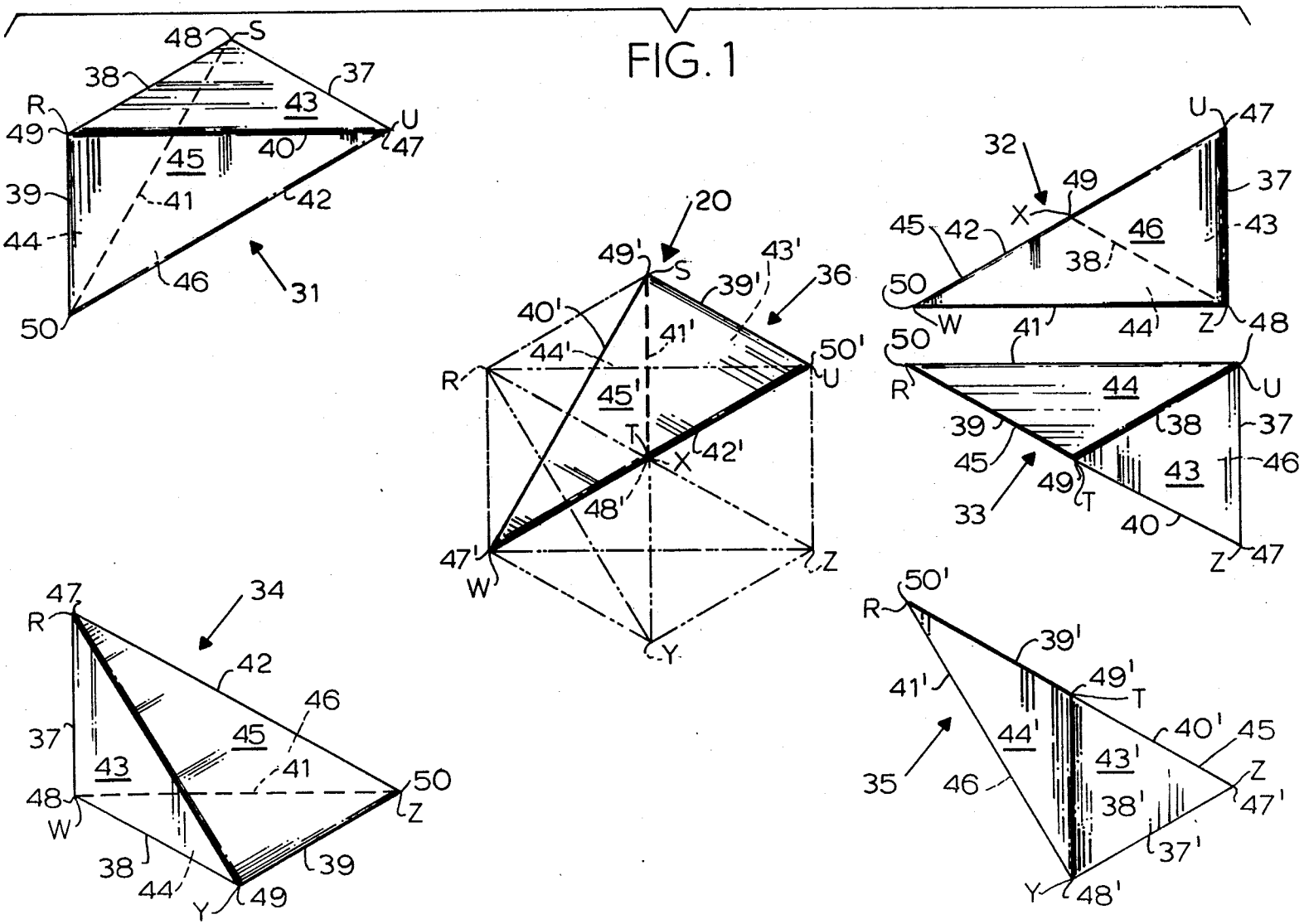
FIG. 1 is a combination exploded and assembled view (the exploded portions being shown in solid lines and the assembly in broken lines) except for one tetrahedron, of a cube made up of six tetrahedrons and embodying the principles of the invention or of one portion thereof.
Figure 2:
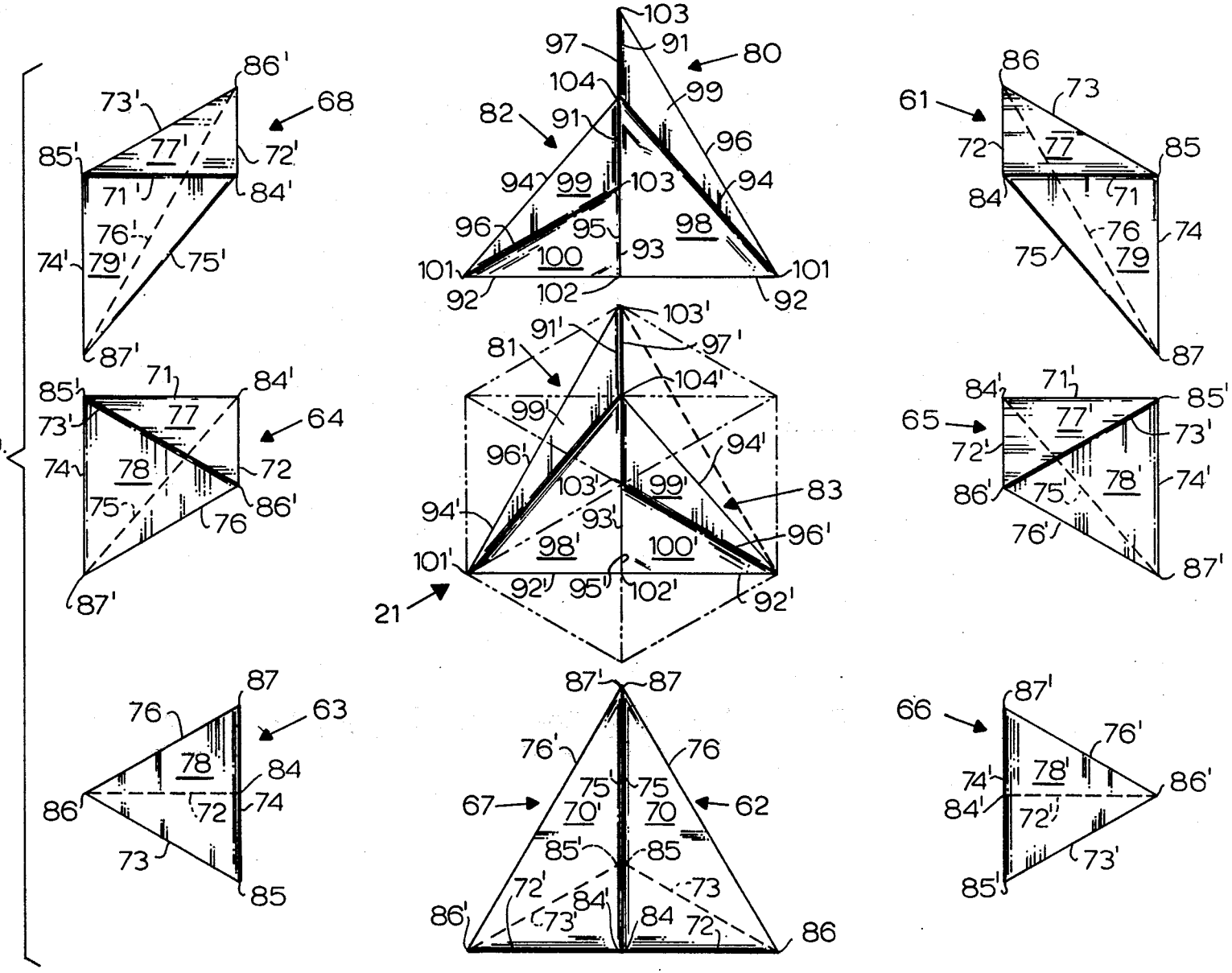
FIG. 2 is a similar view of another cube made up of twelve tetrahedrons with the individual tetrahedrons or partial subassemblies shown in solid lines and the assembly as a cube in broken lines, except for one tetrahedron thereof.

One aspect of the invention is well exemplified by FIGS. 1–4 in which three cubes are broken down into tetrahedrons in different ways. FIG. 1 and FIG. 4-A exemplify a cube 20 made up of six tetrahedrons; FIGS. 2 and 4-B, a cube 21 made up of twelve tetrahedrons; and FIGS. 3 and 4-C, a cube 22 made up of twenty-four tetrahedrons.

In each instance, the tetrahedrons are groupable into pairs of sets of identical tetrahedrons with symmetry between each pair of sets. For example, in FIG. 1 there are two subsets, with four identical tetrahedrons, 31, 32, 33, and 34, in one set and two identical tetrahedrons, 35 and 36, in the other, which are symmetrical to those in the first subset. This is true also of the cubes of FIGS. 4-B and 4-C, in each of which there are four subsets, meaning two pairs of sets for each with the tetrahedrons in each pair being symmetrical to those in one other pair, and identical to each other in the pair.

Looking first at FIG. 1 for a moment, the solid lines show six tetrahedron blocks of which tetrahedrons 31, 32, 33, and 34 belong to a first subset; these four tetrahedrons 31, 32, 33, and 34 are exactly identical to each other. The other two tetrahedrons, 35 and 36, belong to a second subset and are identical to each other. They are also symmetrical to those in the first subset. The edges of the second subset correspond to the edges of the first subset and are given the same reference numeral plus a prime. As made, in all six tetrahedrons 31, 32, 33, 34, 35, and 36, the relationship of the length of their six edges taking the shortened edges as equal to 1, among themselves, is as follows:

TABLE I

| Edge Lengths of the Tetrahedrons of FIG. 1 |
|---|
| $37 = 37' = 1$ |
| $38 = 38' = 1$ |
| $39 = 39' = 1$ |
| $40 = 40' = \sqrt{2}$ |
| $41 = 41' = \sqrt{2}$ |
| $42 = 42' = \sqrt{3}$ |

As can be seen, the six tetrahedrons are readily assembleable into the cube, and as will be explained, are preferably held together by magnetic forces. They are also, as one can see from FIGS. 9 and 10, readily assembled into pyramids. The same cube can be made when there are three tetrahedrons in each subset, as is shown in FIG. 13.

Looking more closely at any one of the tetrahedrons 31, 32, 33, or 34, it will be seen that one face 43 is an isosceles right triangle defined by the edges 37, 38, and 40, and that a second face 44 is also an isosceles right triangle of the same area defined by the edges 38, 39, and 41. A third face 45 of the tetrahedron is a scalar right triangle defined by the edges 39, 40 and 42, while the fourth face is a triangle 46 of exactly the same area as the face 45 formed by the edges 37, 41, and 42. The faces of the symmetrical tetrahedrons 35 and 36 comprising the other subset are designated by the same numbers but with a "prime" added, as 43', 44', 45', and 46'. Further, the four tetrahedrons 31, 32, 33, and 34 leave four vertices 47, 48, 49, and 50, while the two tetrahedrons 35 and 36 have four vertices 47', 48', 49', and 50'.

When the tetrahedron blocks 31, 32, 33, 34, 35, and 36 are assembled into a cube having eight vertices R, S, T, U (at the top as shown in FIG. 1), and W, X, Y, and Z (at the bottom in FIG. 1), the vertices meet as follows:

TABLE II

| Meeting Vertices of the Tetrahedrons and the Cube in FIG. 1. | | |
|---|---|---|
| Tetrahedron | Vertex | Cube Vertex |
| 31 | 49 | R |
| 33 | 50 | R |
| 34 | 47 | R |
| 35 | 50' | R |
| 31 | 48 | S |
| 36 | 49' | S |
| 33 | 49 | T |
| 35 | 48' | T |
| 31 | 47 | U |
| 32 | 47 | U |
| 33 | 48 | U |
| 36 | 50' | U |
| 31 | 50 | W |
| 32 | 50 | W |
| 34 | 48 | W |
| 36 | 47' | W |
| 32 | 49 | X |
| 36 | 48' | X |
| 34 | 49 | Y |
| 35 | 48' | Y |
| 32 | 48 | Z |
| 33 | 47 | Z |
| 34 | 50 | Z |
| 35 | 47' | Z |

TABLE III

| Outside Faces of the Cube of FIG. 1 (Vermilion) | | |
|---|---|---|
| Tetrahedron | Horizontal Face | Vertical Face |
| 31 | 43 | 44 |
| 32 | 44 | 43 |
| 33 | 44 | 43 |
| 34 | 44 | 43 |
| 35 | — | 43',44' |
| 36 | — | 43',44' |

TABLE IV

| Meeting Faces of the Cube of FIG. 1 (Yellow) | | | | |
|---|---|---|---|---|
| Tetrahedron | Face | (Meets) | Tetrahedron | Face |
| 31 | 45 | | (33 | 46 |
| | | | (34 | 46 |
| 31 | 46 | | 36 | 45' |
| 32 | 45 | | 36 | 46' |
| 32 | 46 | | (33 | 46 |
| | | | (34 | 46 |
| 33 | 45 | | 35 | 45' |
| 33 | 46 | | (31 | 45 |
| | | | (32 | 46 |
| 34 | 45 | | 35 | 46' |
| 34 | 46 | | (31 | 45 |
| | | | (32 | 46 |
| 35 | 45' | | 33 | 45 |
| 35 | 46' | | 34 | 45 |

TABLE IV-continued

| Meeting Faces of the Cube of FIG. 1 (Yellow) | | | | |
|---|---|---|---|---|
| Tetrahedron | Face | (Meets) | Tetrahedron | Face |
| 36 | 45' | | 31 | 46 |
| 36 | 46' | | 32 | 45 |

As shown in FIG. 5, each of these six tetrahedrons may be hollow, with walls made, for example, of thin cardboard, plastic sheeting, wood, or metal. To the inner surface and at approximately the center of gravity of each face may be secured a suitable magnet 51, 52, 53, or 54, as by a suitable adhesive or by solder or other appropriate manner, with one of the poles of each magnet parallel to its face and closely adjacent to it. On all of the structures shown, faces identical in area are given the same magnetic polarization. For example, the faces 43' and 44' may have the south pole of the magnet lie adjacent to their walls, while the faces 45' and 46' may have the north pole of the magnet closely adjacent to them. This means that when assembling symmetric parts, the faces that are correctly aligned obtain, from the magnets, forces that tend to hold the parts together strongly enough so that assembly becomes possible. The magnetic force should, of course, more than counteract the forces of gravity while still being light enough so that the tetrahedrons are readily pulled apart by hand.

The cube 21 of FIGS. 2 and 4-B is made up of twelve tetrahedrons which are groupable in four subsets. Two of the subsets contain four identical tetrahedrons each, 61, 62, 63, and 64 and 65, 66, 67, and 68, and are symmetrical to each other. The six edges of each are related to each other with the shortest edge of this particular set being given as 1, as follows:

TABLE V

| Edge Lengths of the Tetrahedrons of FIG. 2 (First two subsets) |
|---|
| $71 = 71' = 1$ |
| $72 = 72' = 1$ |
| $73 = 73' = \sqrt{2}$ |
| $74 = 74' = \sqrt{2}$ |
| $75 = 75' = \sqrt{3}$ |
| $76 = 76' = 2$ |

In addition, there are two other subsets each containing two identical tetrahedrons, 80 and 81, 82 and 83, each symmetrical to each other. In this instance, with the length of the shortest edge = 1, the relationship of the edges is:

TABLE VI

| Edge Lengths of the Tetrahedrons of FIG. 2 (Other two subsets) |
|---|
| $91 = 91' = 1$ |
| $92 = 92' = 1$ |
| $93 = 93' = \sqrt{2}$ |
| $94 = 94' = \sqrt{3}$ |
| $95 = 95' = \sqrt{3}$ |
| $96 = 96' = 2$ |

Looking at the tetrahedrons 61, 62, 63, and 64 more closely, it will be seen that of their four faces, a face 77 is an isosceles right triangle defined by edges 71, 72, and 73; a face 78 is a much larger isosceles right triangle 78 defined by the edges 73, 74, and 76. Two other faces 79 and 70 are scalar right triangles and are respectively defined by the edges 71, 74, and 75 and by edges 72, 75, and 76. There are vertices 84, 85, 86, and 87. Like faces and vertices in the tetrahedrons 65, 66, 67, and 68 are given the same numbers with a "prime" added.

The tetrahedrons 80 and 81 are different, but again, all of the faces are right triangles. In this instance, there are two pairs of identical faces, both pairs being scalar right triangles but somewhat different in dimension. A face 97 is defined by the edges 91, 93 and 95, while face 98 is defined by the edges 92, 93, and 94. The larger faces 99 and 100 are respectively defined by the edges 91, 94, and 96, by the edges 92, 95, and 96. There are vertices 101, 102, 103, and 104. The tetrahedrons 82 and 83 correspond, and their reference numerals include "primes".

All of the tetrahedrons of this cube 21 are similar in structure to the tetrahedrons in the first set, that is, being hollow and having walls with magnets located and polarized as set forth earlier.

The set of FIG. 1 is related to the set of FIG. 2 is size also, such that the length of the shortest edge of the larger tetrahedron is the $\sqrt{2}$ times the length of the shortest edge of the smaller set. In other words, the sets are related such that the diagonal of a triangle made up of the two shortest edges in the set of FIG. 2 is the base dimension for the set of FIG. 1.

As shown in FIG. 4-C, the third cube 22 can be considered as made up of four rectangular parallelepipeds 110, 111, 112, and 113, and one of these is shown in FIG. 3 in order to show the individual tetrahedrons. In the cube 22 as a whole, since these parallelepipeds are identical, there are four times as many. Thus, there are four subsets of tetrahedrons, and two of the subsets each comprise eight identical tetrahedrons and the two subsets are symmetrical to each other. There will, of course, be two of each of these tetrahedrons in each of the four parallelepipeds; these are the tetrahedrons 114, 115, 116, and 117 shown in FIG. 3. The other two subsets comprise a total of four identical tetrahedrons each, and these two subsets are also symmetrical to each other so that there will be one from each of these two subsets in each rectangular parallelepiped; these are the tetrahedrons 118 and 119 shown in FIG. 3.

The edges in this group are related in length to their shortest edge, so taking that as equal to 1, the six edges of the first and second subsets of FIG. 3 are related as follows:

TABLE VII

| Edge Lengths of First Two Subsets of Tetrahedrons of FIG. 3 |
|---|
| 120 = 120′ = 1 |
| 121 = 121′ = 1 |
| 122 = 122′ = $\sqrt{2}$ |
| 123 = 123′ = 2 |
| 124 = 124′ = $\sqrt{5}$ |
| 125 = 125′ = $\sqrt{6}$ |

The tetrahedrons 114 and 115 have four faces as follows: there is a face 126 which is an isosceles right triangle bounded by the edges 120, 121, and 122; the other three faces 127, 128, and 129 are all scalar right triangles, and are as follows: the face 127 is bounded by the edges 120, 123, and 124; the face 128 is bounded by the edges 121, 124, and 125, while the face 129 is bounded by the edges 122, 123, and 125. There are vertices 130, 131, 132, and 133. The tetrahedrons 116 and 117 have corresponding faces and vertices designated by the same reference numerals but with a "prime".

The third and fourth subsets, tetrahedrons 118 and 119, are similarly related as with their edges being the following lengths:

TABLE VIII

| Edge Lengths of Other Two Subsets of Tetrahedrons of FIG. 3 |
|---|
| 134 = 134′ = 1 |
| 135 = 135′ = 1 |
| 136 = 136′ = 2 |
| 137 = 137′ = $\sqrt{5}$ |
| 138 = 138′ = $\sqrt{5}$ |
| 139 = 139′ = $\sqrt{6}$ |

The tetrahedrons 118 and 119 have faces 140 and 141 which are identical in size and shape, the face 140 being bounded by the edges 134, 136, and 137, while the face 141 is bounded by the edges 135, 136, and 138. The other two faces 142 and 143 are also identical to each other. The face 142 is bounded by the edges 135, 137, and 139, while the face 143 is bounded by the edges 134, 138, and 139. There are vertices 144, 145, 146, and 147.

Once again, all the tetrahedrons that go to make the cube 22 are hollow and are provided with magnets in exactly the manner described before.

The walls of the various tetrahedrons may be transparent or opaque, and they may be all the same color or same appearance, or to make assembly somewhat easier, all congruent faces, whether in one set or another, may be the same color and all different faces a different color. Thus, the faces 140 and 141 may be the same color as may be the faces 142 and 143. Similarly, the faces 140 and 141 may be the same color as the faces 127 and 127′ of the tetrahedrons 114, 115, 116, and 117; and the face 128 of the tetrahedron 114 may be the same color as the identical sized and shaped face 79 of the tetrahedron 61 in the second set.

The set of FIG. 3 is related to the set of FIG. 2, and the relationship of its shortest edge is the $\sqrt{2}/2$ times the shortest edge of the set of FIG. 2, and it is also related to the first subset in that its shortest edge is ½ that of the set of FIG. 1. These relationships may be tabulated as follows, starting from the smallest tetrahedrons, those of FIG. 4-C:

TABLE IX

| Relationships Between the Edge Lengths of the Tetrahedrons of FIGS. 1–4 | | | |
|---|---|---|---|
| Set | Subset | Tetra-hedrons | Edge Length 1 = length of idea 120 |
| FIGS. 3 and 4-C | First and Second | 114 to 117 | 120 = 120′ = 1 |
| | | | 121 = 121′ = 1 |
| | | | 122 = 122′ = $\sqrt{2}$ |
| | | | 123 = 123′ = 2 |
| | | | 124 = 124′ = $\sqrt{5}$ |
| | | | 125 = 125′ = $\sqrt{6}$ |
| | Third and | 118, 119 | 134 = 134′ = 1 |

TABLE IX-continued

| Set | Subset | Tetra-hedrons | Edge Length 1 = length of idea 120 |
|---|---|---|---|
| | Fourth | | 135 = 135′ = 1 |
| | | | 136 = 136′ = 2 |
| | | | 137 = 137′ = $\sqrt{5}$ |
| | | | 138 = 138′ = $\sqrt{5}$ |
| | | | 139 = 139′ = $\sqrt{6}$ |
| FIGS. 2 and 4-B | Fifth and Sixth | 61 to 68 | 71 = 71′ = $\sqrt{2}$ |
| | | | 72 = 72′ = $\sqrt{2}$ |
| | | | 73 = 73′ = 2 |
| | | | 74 = 74′ = 2 |
| | | | 75 = 75′ = $\sqrt{6}$ |
| | | | 76 = 76′ = 2$\sqrt{2}$ |
| | Seventh and Eighths | 80 to 83 | 91 = 91′ = $\sqrt{2}$ |
| | | | 92 = 92′ = $\sqrt{2}$ |
| | | | 93 = 93′ = 2 |
| | | | 94 = 94′ = $\sqrt{6}$ |
| | | | 95 = 95′ = $\sqrt{6}$ |
| | | | 96 = 96′ = 2$\sqrt{2}$ |
| FIGS. 1 and 4-A | Ninth and Tenth | 30 to 36 | 37 = 37′ = 2 |
| | | | 38 = 38′ = 2 |
| | | | 39 = 39′ = 2 |
| | | | 40 = 40′ = 2$\sqrt{2}$ |
| | | | 41 = 41′ = 2$\sqrt{2}$ |
| | | | 42 = 42′ = 2$\sqrt{3}$ |

TABLE X

Relationships Between the Tetrahedrons of FIGS. 1–4, as to Face, Edge Length, and Color

| Tetrahedron | Face | Edge Length | Color |
|---|---|---|---|
| 114–117 | 126 = 126′ | 1, 1, $\sqrt{2}$ | Carmine |
| | 127 = 127′ | 1, 2, $\sqrt{5}$ | Orange |
| | 128 = 128′ | 1, $\sqrt{5}$, $\sqrt{6}$ | Blue |
| | 129 = 129′ | $\sqrt{2}$, 2, $\sqrt{5}$ | Purple |
| 118, 119 | 140 = 140′ | 1, 2, $\sqrt{5}$ | Orange |
| | 141 = 141′ | 1, 2, $\sqrt{5}$ | Orange |
| | 142 = 142′ | 1, $\sqrt{5}$, $\sqrt{6}$ | Blue |
| | 143 = 143′ | 1, $\sqrt{5}$, $\sqrt{6}$ | Blue |
| 61–68 | 77 = 77′ | $\sqrt{2}$, $\sqrt{2}$, 2 | Pink |
| | 78 = 78′ | 2, 2, 2$\sqrt{2}$ | Vermilion |
| | 79 = 79′ | $\sqrt{2}$, 2, $\sqrt{6}$ | Purple |
| | 70 = 70′ | $\sqrt{2}$, $\sqrt{6}$, 2$\sqrt{2}$ | Green |
| 80, 81 | 97 = 97′ | $\sqrt{2}$, 2, $\sqrt{6}$ | Purple |
| | 98 = 98′ | $\sqrt{2}$, 2, $\sqrt{6}$ | Purple |
| | 99 = 99′ | $\sqrt{2}$, $\sqrt{6}$, 2$\sqrt{2}$ | Green |

TABLE X-continued

Relationships Between the Tetrahedrons of FIGS. 1–4, as to Face, Edge Length, and Color

| Tetrahedron | Face | Edge Length | Color |
|---|---|---|---|
| | 100 = 100′ | $\sqrt{2}$, $\sqrt{6}$, 2$\sqrt{2}$ | Green |
| 30–36 | 43 = 43′ | 2, 2, 2$\sqrt{2}$ | Vermilion |
| | 44 = 44′ | 2, 2, 2$\sqrt{2}$ | Vermilion |
| | 45 = 45′ | 2, 2$\sqrt{2}$, 2$\sqrt{3}$ | Yellow |
| | 46 = 46′ | 2, 2$\sqrt{2}$, 2$\sqrt{3}$ | Yellow |

Tabulating by color=congruence, we get (See FIGS. 8, 9, and 10):

TABLE XI

Example of Color Coding of Faces

| | Color | Face |
|---|---|---|
| 1. | Carmine | 126,126′ |
| 2. | Orange | 127,127′, 140,140′, 141,141′ |
| 3. | Blue | 128,128′, 142,142′, 143,143′ |
| 4. | Purple | 129,129′, 79,79′, 97,97′, 98,98′ |
| 5. | Pink | 77,77′ |
| 6. | Vermilion | 78,78′, 43,43′, 44,44′ |
| 7. | Green | 70,70′, 99,99′, 100,100′ |
| 8. | Yellow | 45,45′, 46,46′ |

Thus, the five different tetrahedron sizes used are made from eight different sizes of faces, and moreover, from a total of seven different edge lengths:

TABLE XII

Edge Lengths Related to All Edges of All Tetrahedrons of FIGS. 1–4

| Edge Length | Edge |
|---|---|
| 1. 1 | 120,120′, 121,121′, 134,134′, 135,135′ |
| 2. $\sqrt{2}$ | 122,122′, 71,71′, 72,72′, 91,91′, 92,92′ |
| 3. 2 | 123,123′, 136,136′, 73,73′, 74,74′, 93,93′ 37,37′, 38,38′, 39,39′ |
| 4. $\sqrt{5}$ | 124,124′, 137,137′, 138,138′ |
| 5. $\sqrt{6}$ | 125,125′, 139,139′, 75,75′, 94,94′, 95,95′ |
| 6. 2$\sqrt{2}$ | 76,76′, 96,96′, 40,40′, 41,41′ |
| 7. 2$\sqrt{3}$ | 42,42′ |

Other sets of these tetrahedrons may be made. For example, a set may be made having twice as many tetrahedrons as the set of FIG. 3, as may be made by bisecting each tetrahedron of the cube of FIG. 4-C; and this is shown in FIG. 13. With the shortest length of these being shown as one, there are again four subsets in two groups with those of related subsets being symmetric. The relationship of the length of edges with the shortest edge of this set being set as one would then be for the first two subsets, that of 1, 1, $\sqrt{2}$, 2$\sqrt{2}$, 3, $\sqrt{10}$, and for the other two subsets, that of: 1, 1, 2$\sqrt{2}$, 3, 3, $\sqrt{10}$. Here again, the shortest edge may be related such that the shortest edge of the set of FIG. 3 is the $\sqrt{2}$ times as long, or in other words, diagonal of a triangle made up of the two shortest edges of this fourth set. Other sets are, of course, possible.

In addition to the use of the magnets to help hold these parts together, color patterns, such as those described above, are desirable. Colors can be selected so that the sides which properly face each other can be identical. This is better adapted for getting everything together. If confusion is desired, the colors need not be used, or they can be used without any particular order; and this makes the whole perhaps more puzzling, though not necessarily more interesting.

While the cubes form a very important relationship in use whether for play, instruction, or puzzling, they present only one aspect of the possible assemblies. It is possible to have a plurality of any one or more of the sets available so that further construction becomes possible. Pyramids are readily formed as are groups of pyramids (See FIGS. 11 and 12), and from them, other interesting figures. The use of the magnets makes this all the more interesting because faces cannot be put together that repel each other. The various shapes that can be achieved by the use of matching sides together become quite interesting indeed.

The fact that each tetrahedron is made up of four triangular faces is also interesting and goes along with the proportions shown, for example, in the set of FIG. 1 with the relationships given, there are two isosceles right triangles and one triangle in which the relationship of the edges as to the shortest side of this test is that of: 1, $\sqrt{2}$, $\sqrt{3}$. This applies to all of the tetrahedrons of the set of FIG. 1.

The set of FIG. 2, of course, contains two different types of tetrahedrons, the more numerous one has one isosceles triangle based on the smallest side (edges 1, 1, $\sqrt{2}$) and another one based on the diagonal of the first one ($\sqrt{2}$, $\sqrt{2}$, 2). There is a third triangular face of the relationship of 1, $\sqrt{2}$, $\sqrt{3}$, and a fourth one in the relationship of 1, $\sqrt{3}$, 2. All of these, of course, are taken on the shortest side of this particular set and to be put into relationship with the other sets must be considered in relation to the $\sqrt{2}$.

The other two subsets have two triangles with a relationship of 1, $\sqrt{3}$, and 2 for their edges and two triangles with a relationship of 1, $\sqrt{2}$, $\sqrt{3}$.

The set of FIG. 3 is also interesting. There are again four different tetrahedrons, but two of the sets are symmetric to each other and so their relationships are the same. In two sets, there are four different triangles with the relationship of an isosceles right triangle (1, 1, $\sqrt{2}$), a triangle in the relationship of 1, 2, $\sqrt{5}$, one with the relationship of 1, $\sqrt{5}$, $\sqrt{6}$, and one in the relationship of $\sqrt{2}$, 2, $\sqrt{6}$.

The third and fourth subsets of this series form two triangles in the relationship of 1, 2, $\sqrt{5}$ and two triangles in the relationship of 1, $\sqrt{5}$, $\sqrt{6}$. These fairly simple relationships may also be used in teaching algebra or analytic geometry.

It will also be apparent that those triangles which are isosceles right triangles have two 45° angles within them whereas those in the relationship of 1, 2, $\sqrt{3}$, include one 30° angle and one 60° angle. The other angles become interesting, too.

Figure 6:
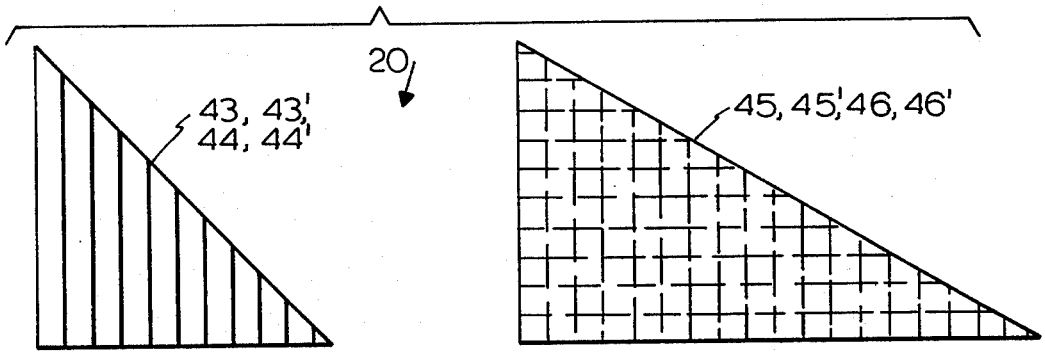
FIG. 6 is a plan view of each of the two different faces that are employed, twice each, in the tetrahedrons used to make up the cube in FIG. 1 and FIG. 4-A. The faces have been shown only once each, with reference numerals appropriate to all the faces of that particular size and shape. The right isosceles triangular face of FIG. 6 has been shaded to indicate the color of vermilion, while the scalar right triangle of FIG. 6 has been shaded to indicate the color yellow.
Figure 7:
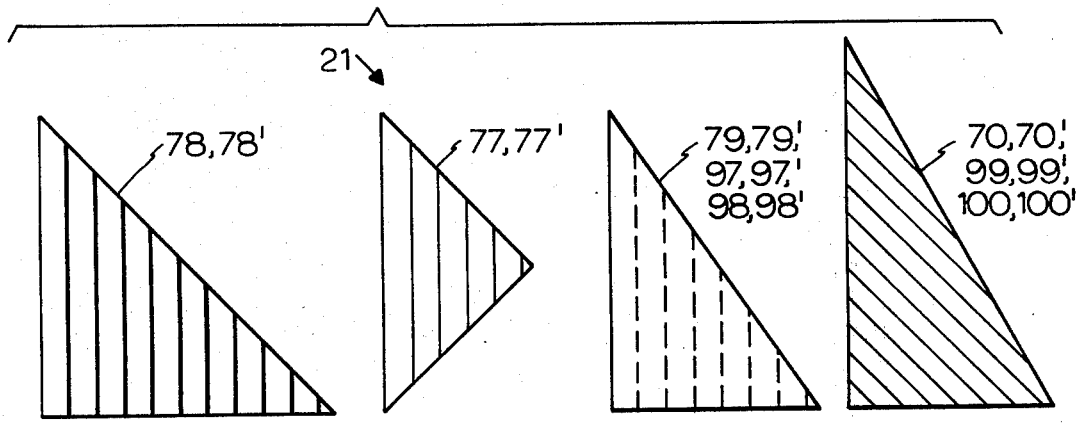
FIG. 7 is a plan view of each of the four triangular faces of the tetrahedrons of FIGS. 2 and 4-B. The larger isosceles right triangle, which is the same size and shape as that shown in FIG. 6, has been similarly shaded to indicate the color vermilion; the second and smaller isosceles right triangle has been shaded to indicate the color pink; the first and smaller scalar right triangle has been shaded to indicate the color purple; while the second scalar triangle, which is larger, has been shaded to indicate the color green.
Figure 8:
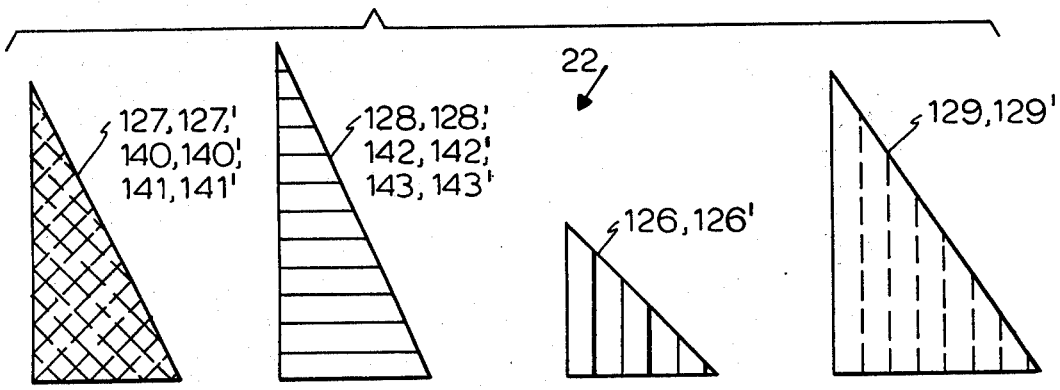
FIG. 8 is a plan view of each of the four triangular faces of the tetrahedrons of FIGS. 3 and 4-C. The scalar triangle at the left has been shaded to indicate the color orange; the second from left scalar triangle has been shaded to indicate the color blue; the small isosceles right triangle has been shaded to indicate the color carmine; and the scalar triangle at the right has been colored to indicate the color purple, as in FIG. 7 where there is a face of identical size and shape.

Using the colors as described for FIGS. 6, 7, and 8, as shown above in some of the tables, one can take the tetrahedrons of FIGS. 2 and 4-B, the faces of which are shown in FIG. 7, and make a pyramid, such as that shown in FIG. 9, in which the four erect faces are green, while the base is pink. One could also make a pyramid in which the outer faces are orange. Using the pyramid shown in FIG. 9 in which the outer faces are green, it will be noted that this pyramid is half a regular octahedron, the octahedron being sliced in the middle to provide the base. Its four main faces are identical equilateral triangles joining at the apex, and each is made up of two "green" faces 78. The base on which it rests is made up of the pink face of 77 and 77', and describes a square. The two green faces that make up a single face of the pyramid convert that face into an equilateral triangle with the edge length of $2\sqrt{2}$. Thus, the edges of the pyramid are the same length as the edges of its base square.

FIG. 10 shows the tetrahedron, which is made by placing together so that they face each other, all the purple faces of the remaining tetrahedrons of FIG. 2 so that the green faces are seen. This makes an equilateral tetrahedron with the same face and edge length as that of the pyramid, so that each edge is the same length, and each face of the new large tetrahedron is the same area and shape as each of the sloping faces of the pyramid of FIG. 9. When the green tetrahedron is used as a core and the faces of the pyramid are placed so that their green faces are superimposed upon the proper green faces of the tetrahedron, the cube of FIGS. 2 and 4-B is formed. In other words, the tetrahedrons used to form the pyramid of FIG. 8 can be used to form a cube enclosing a hollow space, which is a tetrahedron of the same size as that made by the assembly of the tetrahedrons in FIG. 10. Thus, it may be said that the basic "green" pyramid of FIG. 8 can be turned inside out to make a cube, the hollow space of which is an equilateral tetrahedron.

When one has available a number of sets of this particular cube of FIG. 4-B, one can make even more interesting figures as by combining five of the tetrahedrons of FIG. 10 to give a most interesting shape. Many other shapes can be made.

Not illustrated but easily constructed, is a blue pyramid made from the tetrahedrons of the parallelepiped of FIG. 3, with the blue faces forming the sloping face thereof. In the same way, tetrahedrons used to form a pyramid can be turned inside-out to make the parallelepiped which can be used in turn to define a hollow space corresponding to the assembly of the remaining members.

Similarly, but not shown, a yellow pyramid may be made from two cubes like that of FIG. 4-A. To make such a pyramid it is necessary to have eight tetrahedron blocks, which means a cube and a half, or better, two cubes but not using all the blocks. Using the eight pieces of two cubes and reserving the four left over, one can make the basic yellow pyramid and then turn it inside-out to make a six-sided rectangular block having a volume of twice the green cube of FIG. 4-B, and the inside part will then be a tetrahedron made from the four remaining pieces.

Since each of these pyramids that have equilateral faces on a square base is in effect half of a regular octahedron, it is possible to make the regular octahedron from two of the pyramids.

By obtaining enough blocks, numerous very interesting and instructive and beautiful forms can be made. Pluralities of pyramids can be made, which in turn can be interleaved with transparent sheets to make unusual forms, as shown in FIGS. 11 and 12.

FIGS. 14 through 18 show another arrangement comprising a group of the same basic tetrahedron blocks, consisting of four sets of twelve tetrahedron blocks each, each face of each block still being a right triangle. Each set is capable of assembly as a rectangular parallelepiped 200, 201, 202, or 203 of the height h with upper and lower square faces, as shown in FIG. 14. As shown in FIGS. 15–17, each set is also capable of assembly as a combination of a square-base pyramid 205, 206, 207, or 208 with four identical isosceles triangle faces (FIG. 15) and a large tetrahedron 210, 211, 212, 213 with four identical isosceles triangle faces, as shown in FIGS. 16 and 17.

In the set from which the figures 201, 206, and 211 are made, the parallelepiped 201 is a cube of height h, length h, and breadeth h; its pyramid 206 has equilateral triangular faces and has a height h equal to that of the cube; and its large tetrahedron 211 is also equilateral.

In the other three sets, the parallelepipeds 200, 202, and 203 are also of the same height h, and their length and breadth are each equal to each other, but they are respectively equal to $h\sqrt{2}$, $h\sqrt{2}$, and $h/2$. For these sets, the base length of every side of each pyramid 205, 207, and 208 is the same and is equal, respectively, to $h\sqrt{2}$, $h\sqrt{2}$, and $h/2$.

In all sets, the faces of the large tetrahedrons 210, 211, 212, and 213 are all mirror images of the faces of the pyramid 205, 206, 207, or 208 of its set.

In the instance of the largest set, that of the solids 200, 205, and 210, the set consists of two matching subsets of six identical tetrahedron blocks each, those of one subset being symmetric to those of the other subset. The other three sets consist of four subsets each, with two matching subsets a and b having four identical blocks each and symmetrical to those of its matching subset and two other matching subsets c and d having two identical blocks each and symmetrical to those of its matching subset.

The tetrahedron blocks have the following edge lengths, were 1=shortest edge, and $h=2\sqrt{2}$:

TABLE VIII

| Parallelepiped | Pyramid | Large Tetrahedron | Subset | Edge Lengths Related to All Edges of All Tetrahedrons of FIGS. 14–18: Edge Length |
|---|---|---|---|---|
| 203 | 208 | — | a,b | $1, 1, \sqrt{2}, 2\sqrt{2}, 3, \sqrt{10}$ |
| 203 | — | 213 | c,d | $1, 1, 2\sqrt{2}, 3, 3, \sqrt{10}$ |
| 202 | 207 | — | a,b | $\sqrt{2}, \sqrt{2}, 2, 2\sqrt{2}, \sqrt{10}, 2\sqrt{3}$ |
| 202 | — | 212 | c,d | $\sqrt{2}, \sqrt{2}, 2\sqrt{2}, \sqrt{10}, \sqrt{10}, 2\sqrt{3}$ |
| 201 | 206 | — | a,b | $2, 2, 2\sqrt{2}, 2\sqrt{2}, 2\sqrt{3}, 4$ |
| 201 | — | 211 | c,d | $2, 2, 2\sqrt{2}, 2\sqrt{3}, 2\sqrt{3}, 4$ |
| 200 | 205 | 210 | — | $2\sqrt{2}, 2\sqrt{2}, 2\sqrt{2}, 4, 4, 2\sqrt{6}$ |

The set used to make the parallelepiped 203 is made by bisecting the tetrahedrons in the set 202, and can be made into a cube by putting four parallelepipeds 203 together; and this parallelepiped corresponds exactly to the four parallelepipeds of FIG. 4-C. Hence, by using 48 tetrahedrons of that type, the cube of the size of FIG. 4-C can be made thereby.

Another system for color use involves having all of the isosceles right triangles blue, alternating according to size between azure blue and pale blue. Thus, the smallest isosceles right triangular faces would be azure blue, the next larger pale blue, the still larger ones azure blue again, and the largest faces pale blue again. This makes those triangles which are the same proportion be the same basic color, blue, with contrast between pale blue and azure blue adding to designs worked out by the blocks.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A group of tetrahedron blocks consisting of a series of interrelated sets with every block in every set being a tetrahedron and every face of every tetrahedron being a right triangle, each set being capable of assembly into a cube, the cubes for all sets being identical in size, a first said set consisting of twice as many tetrahedron blocks as a second said set and four times as many tetrahedron blocks as a third said set.

2. The group of blocks of claim 1 comprising four sets with the fourth set consisting of twice as many tetrahedron blocks as the first said set.

3. The group of blocks of claim 1 wherein the tetrahedron blocks are hollow and each has magnets affixed to the inner side of its faces, with polarization such that upon assembly into its cubes, the magnets of facing faces attract each other.

4. The group of blocks of claim 1 wherein faces of the same size and shape are colored alike throughout all sets, each size and shape having a different color.

5. A block group that comprises at least three sets of blocks, each set being capable of assembly into a cube, all cubes being the same size, a first set having twice as many blocks as a second set and four times as many as a third set, and so on, each and every block being a tetrahedron with magnetized faces, every face of every block being a right triangle, proper assembly positioning the magnetized faces so that they attract each other.

6. The block group of claim 5 wherein there are four sets of blocks, the fourth set having twice as many blocks as said first set.

7. A group of tetrahedron blocks comprising a series of interrelated sets of tetrahedron blocks exclusively, each set being capable of assembly into a cube, the cubes being identical in size, all the tetrahedron blocks in each set having every face thereof a right triangle, the tetrahedron blocks in each set being of different size from those of the other sets, and comprising at least one pair of subsets of identical tetrahedron blocks, the tetrahedron blocks in each subset being symmetric to those in another subset of that pair.

8. The group of claim 7 wherein the tetrahedron blocks in each set have at least one face identical to that in another set.

9. The group of claim 8 wherein there is a different number of tetrahedron blocks in each set.

10. The group of claim 9 wherein there are six tetrahedron blocks in a first said set, twelve in a second said set, and twenty-four in a third said set.

11. The group of claim 10 wherein there are forty-eight tetrahedron blocks in a fourth said set.

12. A group of blocks comprising forty-two tetrahedrons, all faces being right triangles comprising three interrelated sets, each set being capable of assembly into a cube, the three cubes being identical in size, a first set of twenty-four tetrahedrons consisting of four subsets of tetrahedrons, namely first and second subsets each consisting of eight identical tetrahedrons, each tetrahedron of said first subset being symmetric to each tetrahedron of said second subset, and third and fourth subsets each consisting of four identical tetrahedrons, and each tetrahedron of said third subset being symmetric to each tetrahedron of said fourth subset, a second set of twelve tetrahedrons consisting of four subsets of tetrahedrons, namely, fifth and sixth subsets consisting of four identical tetrahedrons, each tetrahedron in said fifth subset being symmetric to each tetrahedron in said sixth subset, and seventh and eighth subsets each comprising two identical tetrahedrons, each tetrahedron of said seventh set being symmetric to each tetrahedron of said eighth set, a third set of six tetrahedrons comprising two subsets, namely a ninth subset of at least three identical tetrahedrons, and a tenth subset of at least two identical tetrahedrons, each tetrahedron of said ninth subset being symmetric to each tetrahedron of said tenth set.

13. The group of claim 12 wherein said ninth set and said tenth subsets each consist of three said tetrahedrons.

14. The group of claim 12 wherein said ninth subset consists of four tetrahedrons and said tenth subset consists of two tetrahedrons.

15. The group of claim 12 comprising an additional set of forty-eight blocks capable of assembly of a cube of the same size as the cube of the three interrelated sets and consisting of four subsets of exclusively right-triangles faced tetrahedrons, namely eleventh and twelfth subsets of sixteen identical tetrahedrons each, each tetrahedron of the eleventh subset being symmetric to each tetrahedron of the twelfth subset, and thirteenth and fourteenth subsets of eight identical tetrahedrons each, each tetrahedron of the thirteenth subset being symmetric to each tetrahedron of the fourteenth subset.

16. A group of blocks comprising forty-two tetrahedrons with only right-triangular faces, comprising three interrelated sets, each set being capable of assembly into a cube, the three cubes being identical in size, A. a first set of twenty-four tetrahedrons comprising four subsets of tetrahedrons, namely, (1) a first subset comprising eight identical tetrahedrons, (2) a second subset comprising eight identical tetrahedrons, each tetrahedron of said first subset being symmetric to each tetrahedron of said second subset and the six edges of each tetrahedron being related to the shortest edge=1, as follows: 1, 1, $\sqrt{2}$, 2, $\sqrt{5}$, $\sqrt{6}$, (3) a third subset comprising four identical tetrahedrons, and (4) a fourth subset comprising four identical tetrahedrons, each tetrahedron of said third subset being symmetric to each tetrahedron of said fourth subset, the six edges of each being related to the shortest edge=1 of the tetrahedrons of said first subset, as follows: 1, 1, 2, $\sqrt{5}$, $\sqrt{5}$, $\sqrt{6}$, B. A second set of twelve tetrahedrons comprising four subsets of tetrahedrons, namely, (1) a fifth subset comprising four identical tetrahedrons, (2) a sixth subset comprising four identical tetrahedrons, each tetrahedron in said fifth subset being symmetric to each tetrahedron in said sixth subset and each having six edges related to the shortest edge=1 of said first subset as follows: $\sqrt{2}$, $\sqrt{2}$, 2, 2, $\sqrt{6}$, $2\sqrt{2}$, and (3) a seventh subset comprising two identical tetrahedrons, (4) an eighth subset comprising two identical tetrahedrons, each tetrahedron of said seventh set being symmetric to each tetrahedron of said eighth set with the six edges of each related to the shortest edge=1 of said first subset, as follows: $\sqrt{2}$, $\sqrt{2}$, 2, $\sqrt{6}$, $\sqrt{6}$, $2\sqrt{2}$, and C. a third set of six tetrahedrons comprising two subsets, namely, (1) a ninth subset of at least three identical tetrahedrons, and (2) a tenth subset of at least two identical tetrahedrons, each tetrahedron of said ninth subset being symmetric to each tetrahedron of said tenth subset and the six edges of each being related to the shortest edge=1 of said first subset as follows: 2, 2, 2, $2\sqrt{2}$, $2\sqrt{2}$, $2\sqrt{3}$.

17. The group of claim 16, wherein said ninth and tenth subsets each consist of three tetrahedrons.

18. The group of claim 17 wherein said ninth subset consists of four tetrahedrons and said tenth subset consists of two tetrahedrons.

19. The group of claim 16 having a fourth set of forty-eight tetrahedrons with all faces right triangles, namely (1) an eleventh subset of sixteen identical tetrahedrons, (2) a twelfth subset of sixteen identical tetrahedrons, each tetrahedron in said eleventh subset being symmetrical to each tetrahedron in said twelfth subset and each having six edges related to the shortest edge=1 of said first subset as follows:

$$\frac{\sqrt{2}}{2}, \frac{\sqrt{2}}{2}, 1, 2, \frac{3\sqrt{2}}{2}, \sqrt{5},$$

(3) a thirteenth subset of eight identical tetrahedrons, and (4) a fourteenth subset of eight identical tetrahedrons, each tetrahedron in said thirteenth subset being symmetrical to each tetrahedron in said fourteenth subset and each having six edges related to the shortest edge = 1 of the first subset as follows:

$$\frac{\sqrt{2}}{2}, \frac{\sqrt{2}}{2}, 2, \frac{3\sqrt{2}}{2}, \frac{3\sqrt{2}}{2}, \sqrt{5}.$$

20. The group of claim 16 wherein said tetrahedrons are hollow and have walls to the inside surface of which are affixed magnets with their polarities arranged to help hold a properly assembled cube together.

21. The group of claim 20 wherein said walls are colored so that all congruent walls have the same color and non-congruent walls are differentiated, some colored walls of symmetric members having their magnets with attraction polarities.

* * * * *

UNITED STATES PATENT AND TRADEMARK OFFICE

CERTIFICATE OF CORRECTION

PATENT NO. : 4,258,479

DATED : March 31, 1981

INVENTOR(S) : Patricia A. Roane

It is certified that error appears in the above–identified patent and that said Letters Patent are hereby corrected as shown below:

Left-hand column of first page, Item [76], address of inventor, "1100 Fulton St. #7" should read --642 Clayton St.--. Right-hand column of first page, last line following the Abstract, "18 Drawing Figures" should read --13 Drawing Figures--. Column 1, line 8, delete "In one arrangement," and change "the" to --The--; delete the paragraph including lines 12-16. Column 2, line 9, delete "In one arrangement," and change "each" to --Each--. Column 2, line 46, "29 2,$\sqrt{2}$, 2, 2,$\sqrt{6}$, and 2$\sqrt{2}$" should read --$\sqrt{2}$,$\sqrt{2}$, 2, 2, $\sqrt{6}$, and 2$\sqrt{2}$ --. Column 3, delete lines 11 through 68. Column 4, delete lines 1 through 30. Column 5, delete lines 53 through 68. Column 6, delete lines 1 through 8; line 12, delete "One aspect of" and change "the" to --The--. Column 8, line 51, after "80 and 81," insert --and--. Column 9, line 24, "is size" should read --in size--. Column 11, line 50, "129 = 129' $\sqrt{2}$, 2, $\sqrt{5}$ Purple" should read --129 = 129' $\sqrt{2}$, 2, $\sqrt{6}$ Purple--.Column 14, delete lines 62 through 68. Column 15, delete lines 1 through 60. Column 17, lines 53-54, "right-triangles faced" should read --right-triangular faced--.

Signed and Sealed this

*Twentieth* Day of *October 1981*

[SEAL]

*Attest:*

GERALD J. MOSSINGHOFF

*Attesting Officer*

*Commissioner of Patents and Trademarks*